US005561892A

United States Patent [19]

Biondo

[11] Patent Number: 5,561,892

[45] Date of Patent: Oct. 8, 1996

[54] HARDWARE FOR BURIAL CASKET

[75] Inventor: John P. Biondo, Batesville, Ind.

[73] Assignee: Batesville Casket Company, Inc., Batesville, Ind.

[21] Appl. No.: 455,326

[22] Filed: May 26, 1995

[51] Int. Cl.[6] ..... A61G 17/00

[52] U.S. Cl. ..... 27/27; 27/1; 16/111 R; 16/115

[58] Field of Search ..... 16/111 R, 114 R, 16/115; 27/1, 2–6, 10, 27, 35

[56] References Cited

U.S. PATENT DOCUMENTS

| | | | |
|---|---|---|---|
| 3,204,286 | 9/1965 | Hillenbrand . | |
| 3,657,764 | 4/1972 | Relly et al. . | |
| 4,237,590 | 12/1980 | Work | 27/35 |
| 4,615,085 | 10/1986 | Hartman . | |
| 5,008,990 | 4/1991 | Craft . | |
| 5,144,727 | 9/1992 | Craft . | |
| 5,309,614 | 5/1994 | Mackirdy | 27/10 |
| 5,461,755 | 10/1995 | Hardigg et al. | 16/112 X |
| 5,463,800 | 11/1995 | Rojder | 27/1 |

*Primary Examiner*—Carl D. Friedman
*Assistant Examiner*—Beth A. Aubrey
*Attorney, Agent, or Firm*—Wood, Herron & Evans

[57] ABSTRACT

A combination burial casket and hardware comprises a casket shell having a wall, a plate secured to the wall and having a rear edge and a forward surface, an arm, adapted to receive and support a handle bar, pivoted to the plate, and including at least one transverse pivot member, with the plate including at least one rearward facing notch formed in the plate rear edge and receiving the at least one transverse pivot member, the plate forward surface concealing the transverse pivot member, and a stop operable between the plate and the arm limiting pivotal movement of the arm relative to the plate. The arm comprises a pair of elongated arm members or is an integral one piece arm member. The transverse pivot member comprises a pivot bar or a pair of pivot pins. The stop comprises a first projection on the plate and second and third projections on the pivot member. Either the plate or the arm include ornamentation. The arm and pivot member are cast as a single part. The plate is cast and includes a cast in place threaded stud concealed by the plate forward surface.

31 Claims, 4 Drawing Sheets

HARDWARE FOR BURIAL CASKET

FIELD OF THE INVENTION

This invention relates generally to burial caskets, and more particularly to hardware for attachment to and handling of a casket.

BACKGROUND OF THE INVENTION

Burial caskets are traditionally provided with hardware mounted peripherally around the shell of the casket for lifting and handling the casket. One form of casket hardware includes an arm with an elongated lifting handle bar attached to one end of the arm, with the other end of the arm being pivoted to a clevis with a rivet. The clevis has a bolt attached to it which passes through a hole in a decorative plate, known as an "ear" or "escutcheon" and through a hole in the casket shell wall. A nut secures the bolt and hence arm and escutcheon plate to the shell wall. The escutcheon plate includes a recess or socket for receiving the clevis and the arm generally includes an upper end which extends over the clevis. Thus once installed the casket hardware presents a decorative escutcheon plate from which depends a decorative arm which in turn supports the handle bar; the combination of arm and escutcheon recess hide from view the utilitarian mechanics of attaching the arm and escutcheon to the casket shell. Such casket hardware is disclosed in, for example, U.S. Pat. Nos. 3,204,286 and 4,615,085, both assigned to the assignee of the present invention.

At least two shortcomings of this type of casket hardware reside in the number and size of the piece parts required to construct the hardware assembly. The hardware assembly requires several separate piece parts which are each individually manufactured resulting in greater manufacturing costs. A number of the parts are rather small in size thus making the assembly of the hardware a tedious job. It is therefore desirable to provide casket hardware which reduces the number of individual piece parts and in particular the number of small piece parts in order that the hardware can be more economically manufactured and assembled. Any such casket hardware must however continue to hide or conceal from normal view the utilitarian mechanical aspects of the attachment of the escutcheon and arm to the casket shell.

Another form of casket hardware includes a mounting plate secured to the casket shell wall. The plate includes a pair of lateral ears. The ears includes apertures for accepting pins or trunnions on the ends of elongated handle bars. A handle bar spans between the facing ears of adjacent mounting plates and the handle bar pins fit in those ears. A separate decorative plate or cover is secured over each mounting plate to conceal the attachment of the handle bar to the ear and of the mounting plate to the casket shell wall. Such casket hardware is disclosed in U.S. Pat. No. 3,657,764 also assigned to the assignee of the present invention.

The shortcoming of this form of hardware resides in the requirement that a separate, decorative plate or cover be installed over the mounting plate in order to conceal the various attachments mentioned above.

It is therefore an objective of the present invention to provide casket hardware which reduces the total number of piece parts, which reduces the number of small piece parts, and which conceals the structural attachment of the hardware to the casket.

SUMMARY OF THE INVENTION

The present invention attains the stated objectives by providing a combination burial casket and hardware. The combination comprises a casket shell having a wall forming a part thereof, a plate secured to the casket shell wall and having a rear casket wall facing edge and a forward surface opposite the rear edge, an arm, adapted to receive and support a handle bar, pivoted to the plate, and including at least one transverse pivot member, the plate including at least one reward facing notch formed in the plate rear edge and receiving the at least one transverse pivot member with the plate forward surface concealing the transverse pivot member, and a stop operable between the plate and the arm limiting pivotal movement of the arm relative to the plate.

In one embodiment, the arm comprises a pair of elongated arm members, with one arm member of the pair of arm members being disposed outboard of each lateral edge of the plate. In this embodiment the at least one transverse pivot member comprises either a pivot bar connecting the pair of elongated arm members at their upper ends or a pair of pivot pins with one pivot pin of the pair of pins being located on each elongated arm member of the pair of arm members at an upper end, and the at least one notch comprises a pair of notches with one notch of the pair being located near each lateral edge of the plate.

In another embodiment, the arm is an integral one piece member having a pair of lateral edges with one lateral edge of the pair being disposed inboard of each lateral edge of the plate. In this embodiment the at least one transverse pivot member comprises a pair of pivot pins, with one pivot pin of the pair of pins being located on each lateral side of the arm at an upper end thereof.

The stop of the hardware comprises a first projection on one of either the plate or the transverse pivot member and second and third projections on the other of either the plate or the transverse pivot member. The second and third projections cooperate with the first projection to permit relative angular movement of the plate and transverse pivot member by only a predetermined angular amount.

The first projection is preferably on the plate and the second and third projections are preferably on the transverse pivot member.

In the embodiment where the arm comprises a pair of elongated arm members the plate preferably includes decoration or ornamentation on its forward surface. In the embodiment where the arm is an integral one piece member the arm preferably includes decoration or ornamentation on its forward surface.

The arm of the hardware of the present invention is preferably in the range of about 6 inches to about 9 inches in length.

The arm and pivot member are preferably cast as a single, integral piece part and the plate is also preferably cast and includes a threaded stud which is cast in place and is concealed by the forward plate surface.

The advantage of the present invention is that casket hardware is provided which reduces the total number of piece parts of the hardware, which reduces the number of small hardware piece parts, and which conceals the structural attachment of the hardware to the casket.

These and other objects and advantages of the present invention will become more readily apparent during the following detailed description taken in conjunction with the drawings herein, in which:

DETAILED DESCRIPTION OF THE INVENTION

Figure 1:
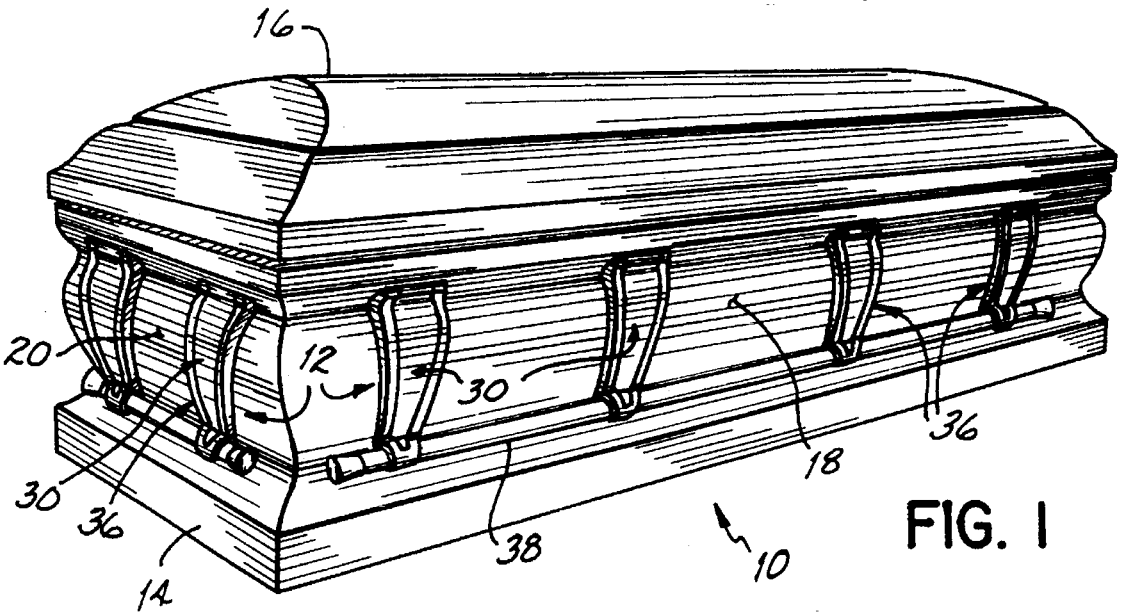
FIG. 1 is a perspective view of a casket including the hardware of the present invention.

Referring first to FIG. 1, there is illustrated a casket 10 including hardware 12 of the present invention. Casket 10 includes a lower shell 14 to which is hinged a cap or lid 16. Shell 14 includes a pair of side walls, one of which is shown at 18, and a pair of end walls, one of which is shown at 20. While the illustrated casket is of metal construction, it will be appreciated that the hardware of the present invention could as well be employed on wood caskets.

Figure 2:
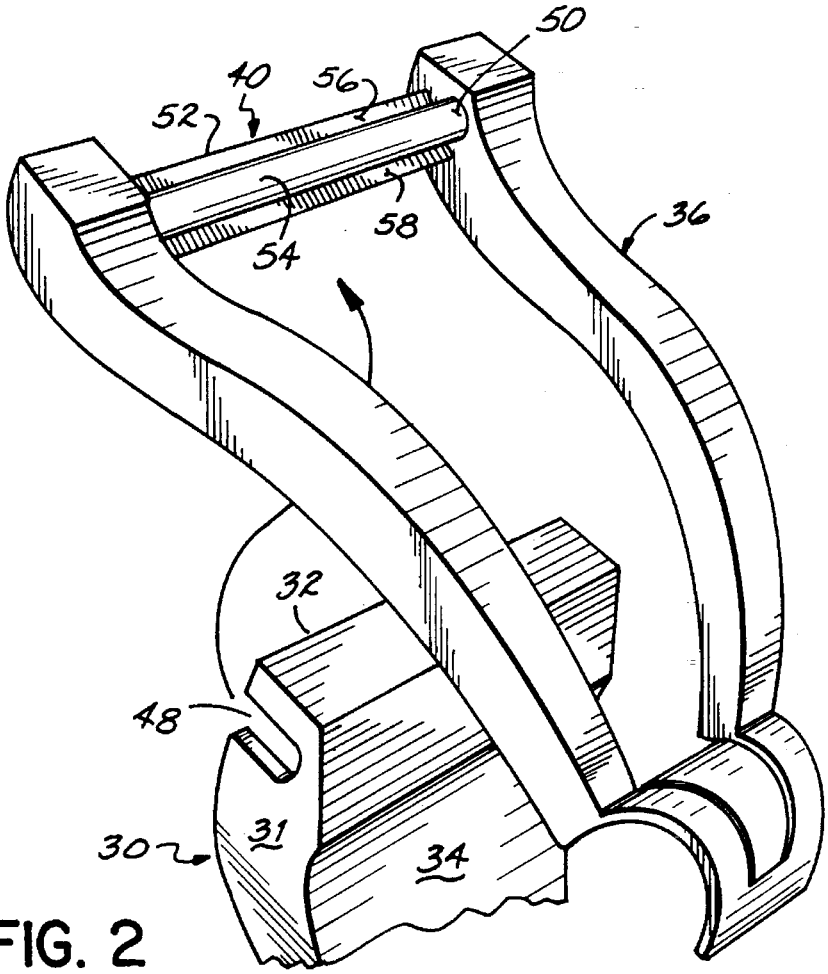
FIG. 2 is a fragmentary perspective view of the hardware of FIG. 1 being assembled.
Figure 4:
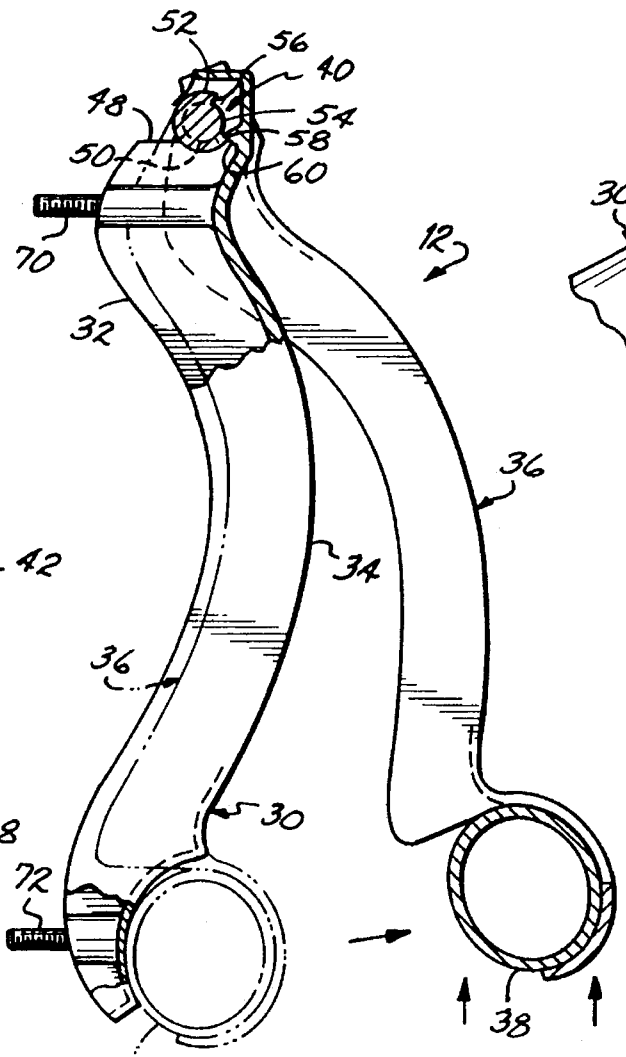
FIG. 4 is a view taken along line 4—4 of FIG. 3.
Figure 3:
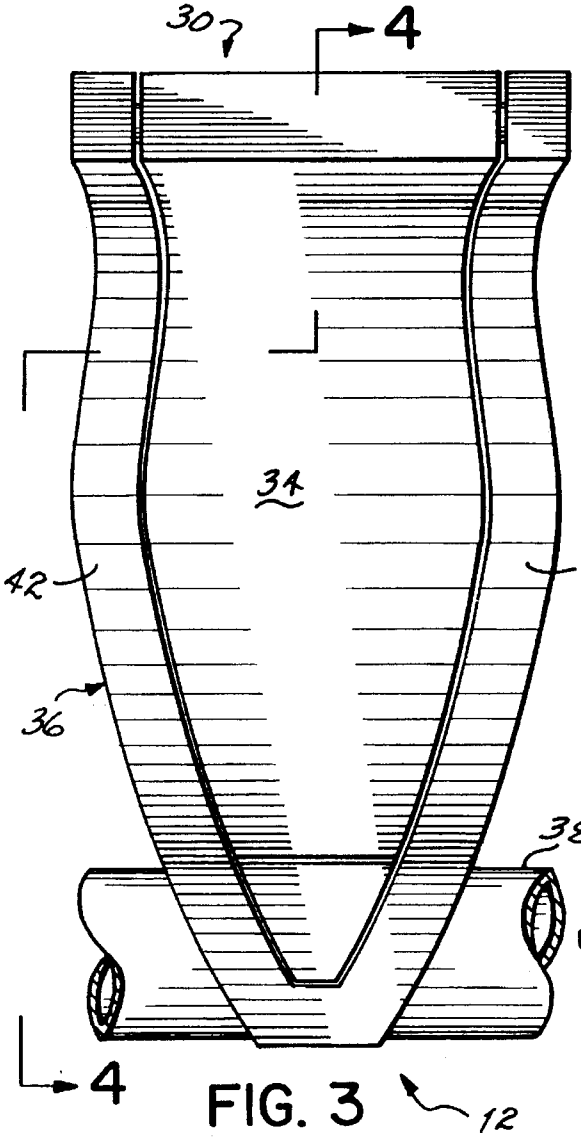
FIG. 3 is a front elevational view of the hardware of FIGS. 1 and 2.
Figure 7:
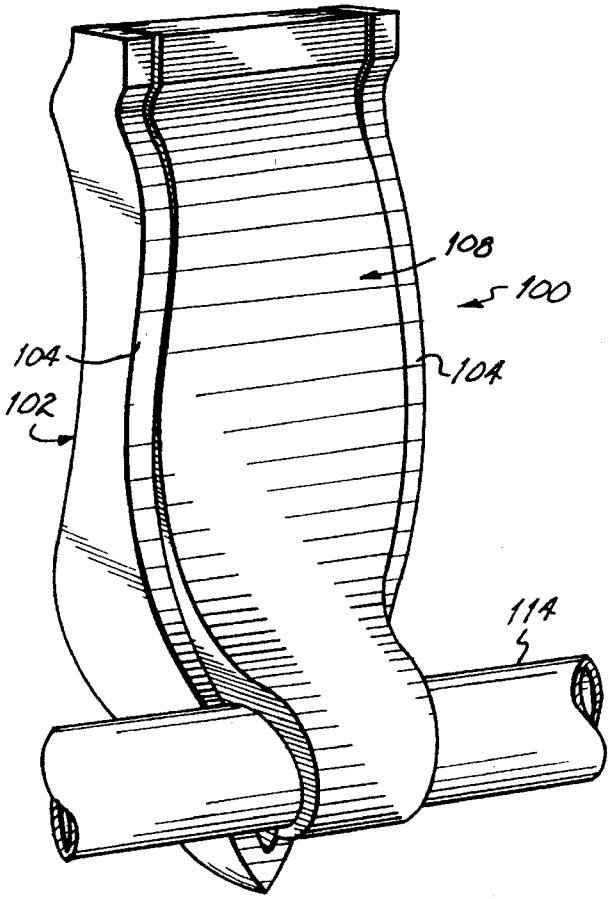
FIG. 7 is a perspective view of the assembled hardware of FIG. 6.

Referring now to FIGS. 2, 3 and 4, the hardware 12 is shown in more detail. The hardware 12 includes a plate 30 which may be secured to casket shell walls 18 and 20. Plate 30 includes a rear casket wall facing edge 32 and a forward surface 34 opposite the rear edge 32. An arm 36 is adapted by conventional means to receive and support, at its lower end, a handle bar 38. The arm 36 is pivoted to the plate 30 by a transverse pivot member 40 which, in the embodiment illustrated in FIG. 2, comprises a pivot bar connected between the upper ends of a pair of elongated arm members 42. The lateral edges 31 of the plate 30 each include a reward facing slot 48 therein projecting forward from rear edge 32 which receives the pivot bar 40 therein. Assembling the arm 36 and the plate 30 as shown in FIG. 2 positions one elongated arm member 42 of the pair of elongated arm members outboard of each lateral edge 31 of the plate 30. The plate forward surface 34, which preferably includes decoration or ornamentation applied thereto, conceals the transverse pivot member 40 and its connection to the plate 30.

As best seen in FIGS. 2 and 4, the pivot bar 40 includes cylindrical outboardmost portions 50 which ride in the slots 48 in plate 30. Intermediate the cylindrical portions 50 is a larger diameter cylindrical portion 52 which has machined therefrom or otherwise formed therein a sector 54 resulting in stop projections 56 and 58. A cooperating stop projection 60 formed as a part of the plate 30 projects rearwardly into and between the projections 56 and 58 when arm 36 and plate 30 are assembled. Stop projections 56, 58 and 60 limit the angular travel of the arm 36 relative to the plate 30 when lifting the casket 10 by the handle 38.

As seen in FIG. 4, plate 30 includes a pair of threaded studs 70 and 72 which secure the plate 30 to the casket shell walls via threaded nuts (not shown). Studs 70 and 72 are preferably cast in place when casting the plate 30 from, for example, zinc. The forward surface 34 thus conceals the studs 70 and 72 from view when installed. Arm 36 and transverse pivot member 40 are likewise preferably cast, and as a single, integral piece from, for example, zinc. The design of the casket hardware readily lends itself to rather elongated, vertical hardware as illustrated in the Figs. wherein the arm 36 is on the order of about 6 inches to about 9 inches in length. When utilizing such elongated casket hardware, care must be taken to limit the angular travel of the arm 36 relative to the plate 30 via stop projections 56, 58 and 60 to ensure that only acceptable levels of torque are applied from the handle 36 to the plate 30 and ultimately to the casket shell walls to avoid oil canning the walls when lifting the casket and its contents by the handle 38. Handle 38, normally disposed closely adjacent to the casket shell wall, is preferably permitted to travel a horizontal distance of only about 1.5 inches from the shell wall to permit grasping of handle 38. Horizontal travel of handle 38 in excess of 1.5 inches is generally not desirable in order to limit the torque generated by lifting the casket 10 and applied through the hardware 12 to the casket wall. Depending upon the shell wall curvature and the length of the handle 38 the required amount of horizontal travel of handle 38 requires an angular travel of arm 36 relative to plate 30 of about 15 degrees to about 20 degrees.

Figure 5:
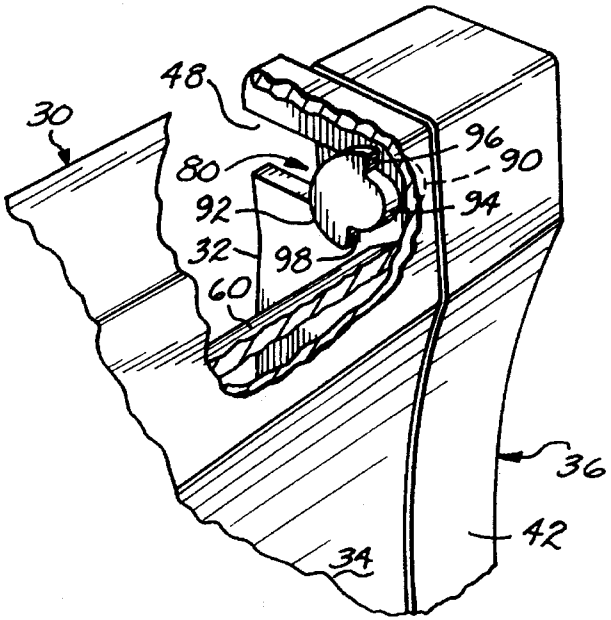
FIG. 5 is a fragmentary perspective view, partially broken away, of the hardware of FIGS. 2–4 but illustrating an alternative form of pivot member.

Referring now to FIG. 5, and with like numbers representing like elements, there is illustrated another form of transverse pivot member which takes the form of a pair of pivot pins, one of which is shown at 80. Each of the pins 80, similar to the pivot bar, includes a cylindrical outboardmost portion 90 which rides in the slot 48 in plate 30. Inboard the cylindrical portion 90 is a larger diameter cylindrical portion 92 which has machined therefrom or otherwise formed therein a sector 94 resulting in stop projections 96 and 98. As in the prior form of transverse pivot member, the cooperating stop projection 60 formed as a part of the plate 30 projects rearwardly into and between the projections 96 and 98 when arm 36 and plate 30 are assembled. Stop projections 96, 98 and 60 limit the angular travel of the arm 36 relative to the plate 30 when lifting the casket 10 by the handle 38.

Referring now to FIGS. 6, 6A, 6B and 7, there is illustrated another form of hardware indicated at 100. In this embodiment, the hardware 100 includes a plate 102 having lateral edges 104 and defining a pocket or cavity 106 therebetween which accepts an integral one-piece arm member 108. In this embodiment, arm 108 includes a pair of pins 110 which are similar in construction to the pins 90 as shown in FIG. 5. Plate 102 includes a pair of rearwardly facing slots 112 which accept the pins 110 in much the same manner as the prior embodiments. The lower end of arm 108 is adapted by conventional means to receive and support a handle bar 114. As in the prior embodiment, the plate 102 may include threaded studs cast in place concealed by the forward plate surface. Alternatively, conventional fasteners (not shown) can be utilized to mount plate 102 via mounting holes 116, as arm 108 normally conceals the heads of the fasteners from view. Arm 108 preferably includes decoration or ornamentation on its forward surface.

Figure 6:
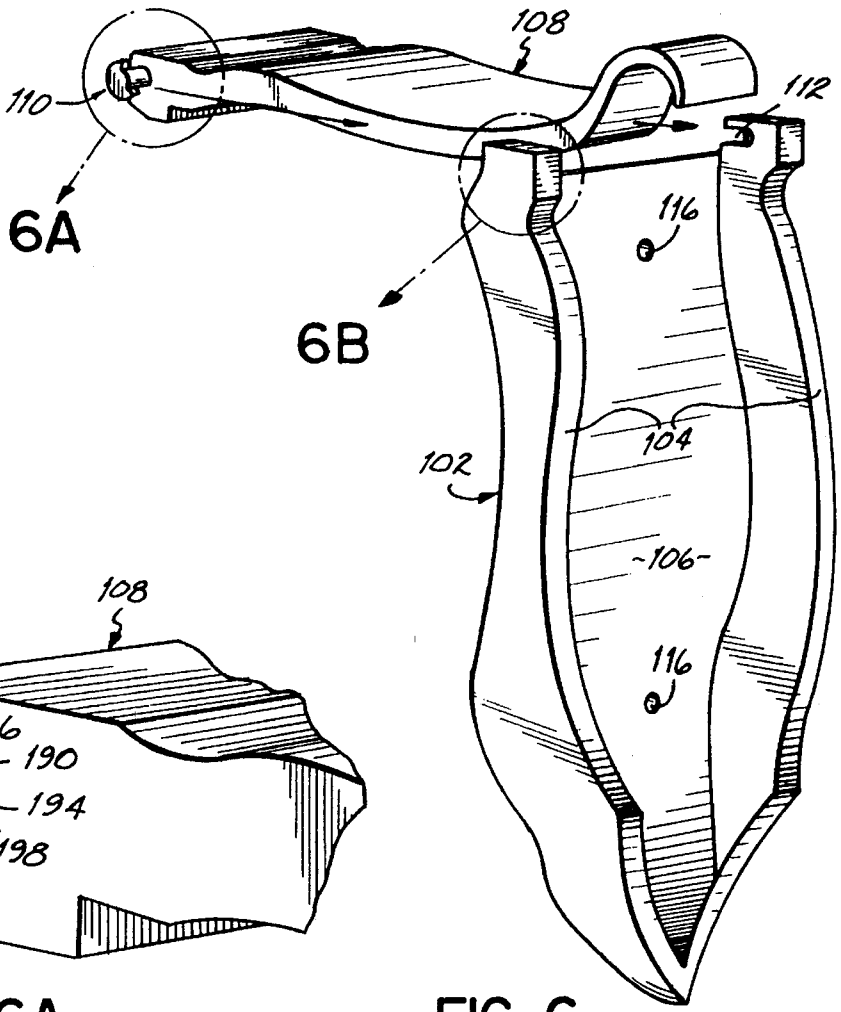
FIG. 6 is a perspective view of an alternative embodiment of the hardware of the present invention being assembled.
Figure 6A:
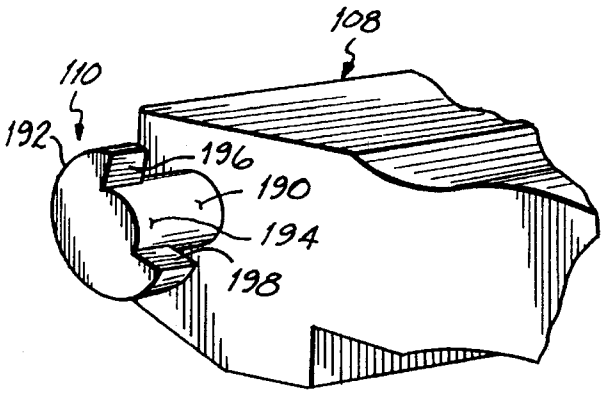
FIG. 6A is an enlarged view of the encircled area 6A of FIG. 6.
Figure 6B:
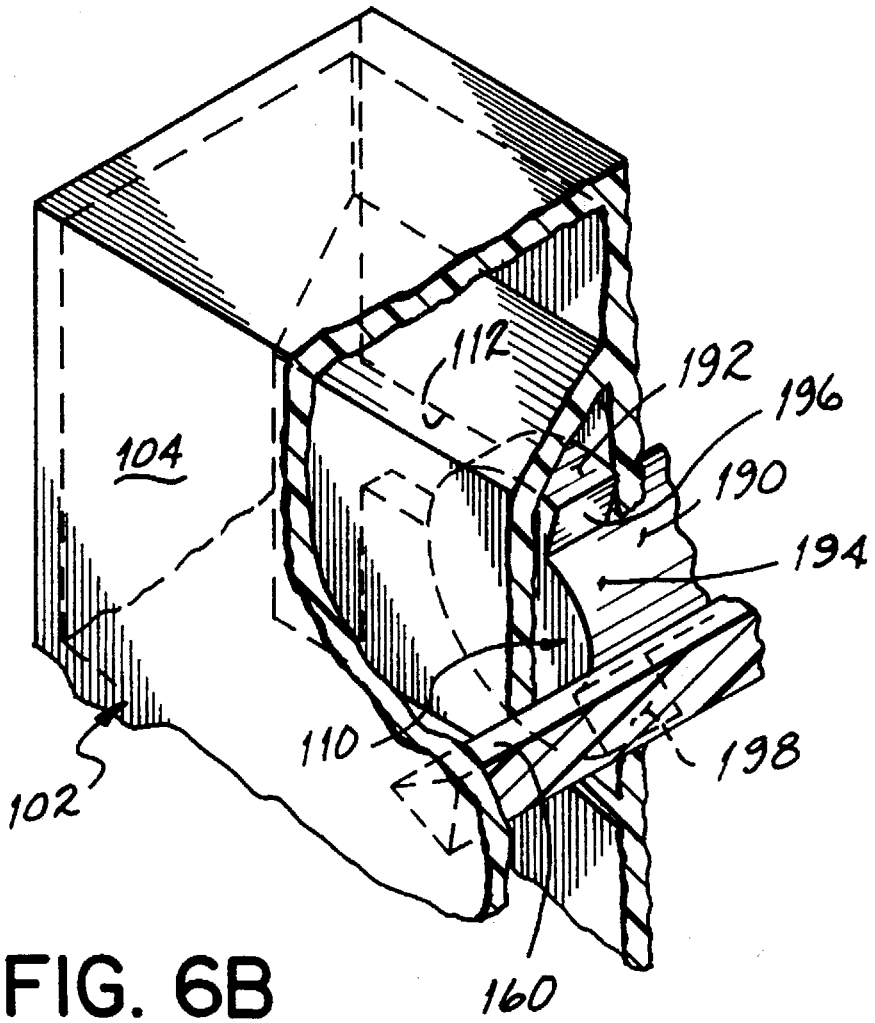
FIG. 6B is an enlarged view of the encircled area 6B of FIG. 6 after assembly.

As seen in FIGS. 6A and 6B, each of the pins 110 includes a cylindrical portion 190 which rides in the slot 112 in the plate 102. A larger diameter cylindrical portion 192 has machined therefrom or otherwise formed therein a sector 194 resulting in stop projections 196 and 198. A cooperating stop projection 160 is formed as a part of the lateral edge 104 of arm 102. The stop projection 160 projects rearwardly into and between the projections 196 and 198 when arm 108 and plate 102 are assembled. Stop projections 196, 198 and 160 limit the angular travel of the arm 108 relative to the plate 102 when lifting the casket 10 by the handle 114.

Those skilled in the art will readily recognize numerous adaptations and modifications which can be made to the present invention which will result in an improved casket hardware, yet all of which will fall within the spirit and scope of the present invention as defined in the following claims. Accordingly, the invention is to be limited only by the scope of the following claims and their equivalents.

What is claimed is:

1. A combination of a burial casket and hardware for lifting said casket, said combination comprising:

a casket shell having a wall forming a part thereof;

a plate secured to said casket shell wall, said plate having a rear casket wall facing edge and a forward surface opposite said rear edge;

an arm, adapted to receive and support a handle bar, pivoted to said plate, said arm including at least one transverse pivot member;

said plate including at least one rearward facing notch formed in said plate rear edge, said at least one notch receiving said at least one transverse pivot member, said plate forward surface concealing said transverse pivot member; and a stop operable between said plate and said arm limiting pivotal movement of said arm relative to said plate.

2. The combination of claim 1 wherein:

said arm comprises a pair of elongated arm members;

one arm member of said pair of elongated arm members being disposed outboard of each lateral edge of said plate.

3. The combination of claim 2 wherein:

said at least one transverse pivot member comprises a pivot bar connecting said pair of elongated arm members at upper ends thereof; and said at least one notch comprises a pair of notches, one notch of said pair of notches being located near each lateral edge of said plate.

4. The combination of claim 2 wherein:

said at least one transverse pivot member comprises a pair of pivot pins, one pivot pin of said pair of pins being located on each elongated arm member of said pair of arm members at an upper end thereof; and said at least one notch comprises a pair of notches, one notch of said pair of notches being located near each lateral edge of said plate.

5. The combination of claim 1 wherein:

said arm is an integral one piece member having a pair of lateral edges;

one lateral edge of said pair of arm lateral edges being disposed inboard of each lateral edge of said plate.

6. The combination of claim 5 wherein:

said at least one transverse pivot member comprises a pair of pivot pins, one pivot pin of said pair of pins being located on each lateral side of said arm at an upper end thereof; and said at least one notch comprises a pair of notches, one notch of said pair of notches being located near each lateral edge of said plate.

7. The combination of claim 1 wherein said stop comprises:

a first projection on one of said plate and transverse pivot member; and second and third projections on the other of said plate and transverse pivot member;

said second and third projections cooperating with said first projection to permit relative angular movement of said plate and transverse pivot member by only a predetermined angular amount.

8. The combination of claim 7 wherein said first projection is on said plate and said second and third projections are on said transverse pivot member.

9. The combination of claim 2 wherein said plate includes decoration or ornamentation on said forward surface.

10. The combination of claim 5 wherein said arm includes decoration or ornamentation on a forward surface of said arm.

11. The combination of claim 1 wherein said arm is in the range of about 6 inches to about 9 inches in length.

12. The combination of claim 1 wherein said arm and at least one pivot member are cast as a single, integral piece part.

13. The combination of claim 12 wherein said plate includes a threaded stud, said plate is cast and said stud is cast in place and concealed by said plate forward surface.

14. A combination of a burial casket and hardware for lifting said casket, said combination comprising:

a casket shell having a wall forming a part thereof;

a plate secured to said casket shell wall, said plate having a rear casket wall facing edge and a forward surface opposite said rear edge;

an arm, adapted to receive and support a handle bar, said arm including a pivot bar spanning the width of said arm;

said plate including a pair of rearward facing notches formed in said plate rear edge, said pair of notches receiving said pivot bar, said plate forward surface concealing said pivot bar; and a stop operable between said plate and said arm limiting pivotal movement of said arm relative to said plate.

15. The combination of claim 14 wherein said arm comprises a pair of elongated arm members, said pivot bar connecting said pair of elongated arm members at upper ends thereof.

16. The combination of claim 14 wherein said stop comprises:

a first projection on one of said plate and pivot bar; and second and third projections on the other of said plate and pivot bar;

said second and third projections cooperating with said first projection to permit relative angular movement of said plate and transverse pivot member by only a predetermined angular amount.

17. The combination of claim 16 wherein said first projection is on said plate and said second and third projections are on said pivot bar.

18. The combination of claim 15 wherein said plate includes decoration or ornamentation on said forward surface.

19. The combination of claim 14 wherein said arm is in the range of about 6 inches to about 9 inches in length.

20. The combination of claim 14 wherein said arm and pivot bar are cast as a single, integral piece part.

21. The combination of claim 20 wherein said plate includes a threaded stud, said plate is cast and said stud is cast in place and concealed by said plate forward surface.

22. A combination of a burial casket and hardware for lifting said casket, said combination comprising:

a casket shell having a wall forming a part thereof;

a plate secured to said casket shell wall, said plate having a rear casket wall facing edge and a forward surface opposite said rear edge;

an arm, adapted to receive and support a handle bar, said arm including a pair of pivot pins, one pivot pin of said pair of pins being located on each lateral side of said arm;

said plate including a pair of rearward facing notches formed in said plate rear edge, said pair of notches receiving said pivot pins, said plate forward surface concealing said pivot pins; and a stop operable between said plate and said arm limiting pivotal movement of said arm relative to said plate.

23. The combination of claim 22 wherein said arm comprises a pair of elongated arm members, one pivot pin of said pair of pins being located on each elongated arm member of said pair of arm members at an upper end thereof.

24. The combination of claim 22 wherein said arm is an integral one piece member, one pivot pin of said pair of pins being located on each lateral side of said arm at an upper end thereof.

25. The combination of claim 22 wherein said stop comprises:

a first projection on one of said plate and pivot pins; and second and third projections on the other of said plate and pivot pins;

said second and third projections cooperating with said first projection to permit relative angular movement of said plate and transverse pivot pins by only a predetermined angular amount.

26. The combination of claim 25 wherein said first projection is on said plate and said second and third projections are on said pivot pins.

27. The combination of claim 23 wherein said plate includes decoration or ornamentation on said forward surface.

28. The combination of claim 24 wherein said arm includes decoration or ornamentation on a forward surface of said arm.

29. The combination of claim 22 wherein said arm is in the range of about 6 inches to about 9 inches in length.

30. The combination of claim 22 wherein said arm and at least pair of pivot pins are cast as a single, integral piece part.

31. The combination of claim 30 wherein said plate includes a threaded stud, said plate is cast and said stud is cast in place and concealed by said plate forward surface.

* * * * *

UNITED STATES PATENT AND TRADEMARK OFFICE

CERTIFICATE OF CORRECTION

PATENT NO. : 5,561,892
DATED : October 8, 1996
INVENTOR(S) : John A. Biondo

It is certified that error appears in the above-indentified patent and that said Letters Patent is hereby corrected as shown below:

Column 2, line 11, "reward" should read -- rearward --.

Column 3, line 44, "reward" should read -- rearward --.

Column 8, line 20 "at least pair" should read -- said pair --.

Signed and Sealed this

Nineteenth Day of August, 1997

*Attest:*

*Attesting Officer*

BRUCE LEHMAN

*Commissioner of Patents and Trademarks*